US005409181A

United States Patent [19]

Patrick

[11] Patent Number: 5,409,181

[45] Date of Patent: Apr. 25, 1995

[54] TISSUE DISPENSER

[76] Inventor: John L. Patrick, 156 E. D St., Upland, Calif. 91785

[21] Appl. No.: 97,773

[22] Filed: Jul. 26, 1993

[51] Int. Cl.[6] ..... B65H 19/00

[52] U.S. Cl. ..... 242/596.2

[58] Field of Search ..... 242/55.2, 55.53, 596, 242/596.2, 597.5; 312/37.41; 206/390, 397, 408, 409, 812

[56] References Cited

U.S. PATENT DOCUMENTS

| | | | |
|---|---|---|---|
| 573,563 | 12/1805 | Yeakel | 206/408 |
| 2,440,974 | 5/1948 | Resch | 312/31 |
| 2,806,738 | 9/1957 | Tsakalas . | |
| 3,472,364 | 10/1969 | Sloan | 242/55.53 |
| 3,592,161 | 7/1971 | Hoffmann . | |
| 3,791,601 | 2/1974 | Broden | 242/55.53 |
| 3,795,355 | 3/1974 | Gerstein | 225/106 |
| 3,935,965 | 2/1976 | Stevens | 221/48 |
| 4,089,481 | 5/1978 | Ciuci | 242/55.53 |
| 4,168,778 | 9/1975 | Buxton | 206/409 |
| 4,274,573 | 6/1981 | Finkelstein | 225/106 |
| 4,306,687 | 12/1981 | Hadtke | 242/55.53 |
| 4,615,442 | 10/1986 | Beeten | 242/55.53 X |
| 4,659,028 | 4/1987 | Wren | 252/55.53 |
| 4,721,264 | 1/1988 | Muscarello | 242/55.53 |
| 4,913,312 | 4/1990 | Boutin | 221/45 |
| 4,936,452 | 6/1990 | Pauley | 242/55.53 X |
| 4,969,575 | 11/1990 | Kobayashi | 221/45 |
| 5,097,998 | 3/1992 | Shimosaki | 225/106 |
| 5,228,632 | 7/1993 | Addison et al. | 242/55.53 |

*Primary Examiner*—Daniel P. Stodola
*Assistant Examiner*—John P. Darling
*Attorney, Agent, or Firm*—Dellett and Walters

[57] ABSTRACT

A readily manufacturable dispenser for roll tissue paper enables use of the paper for general household purposes. First and second parts include longitudinally extending mandrel portions for receiving the roll of tissue that is dispensed through an orifice in the side of the dispenser. The two parts of the dispenser are locked together by an O-ring friction seal between their respective mandrel portions. Knockout tabs in the dispenser end walls enable adaptation to a conventional bathroom fixture.

4 Claims, 2 Drawing Sheets

TISSUE DISPENSER

BACKGROUND OF THE INVENTION

The present invention relates to a tissue dispenser and more particularly to a readily manufacturable dispenser container for receiving a roll of toilet tissue or the like and dispensing the same for general household purposes.

Facial tissue is marketed in interleaved sheet form within a dispenser box from which it can be retrieved one or two sheets at a time. Rolled tissue or toilet tissue which is effectively less expensive could generally be used for the same purpose but lacks attractive packaging as would make the product acceptable for general household use, i.e., other than in a conventional bathroom setting.

A number of dispensing containers have heretofore been proposed for receiving and concealing a tissue roll, but for various reasons have not become popular. Often the mechanical construction has been relatively expensive, or in the opposite sense, too flimsy for repeated use.

SUMMARY OF THE INVENTION

In accordance with the present invention, a readily manufacturable dispenser for a roll of tissue paper is formed to include an interior mandrel portion or tube upon which the tissue paper roll is received. A side or end of the dispenser, extending in a direction substantially orthogonal to the aforementioned mandrel portion, is removable and may be provided with a second short mandrel portion utilized in holding the dispenser together. The mandrel portions are preferably hollow while end walls of the dispenser container are provided with circular knockout tabs or disks which can be removed for alternative mounting of the dispenser on a conventional bathroom fixture.

It is accordingly an object of the present invention to provide an improved dispenser for a roll of tissue paper.

It is another object of the present invention to provide an improved tissue paper roll dispenser that is readily manufacturable and reusable, and which is sufficiently attractive to allow general household use.

It is a further object of the present invention to provide an improved dispenser promoting the economic use of tissue paper.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
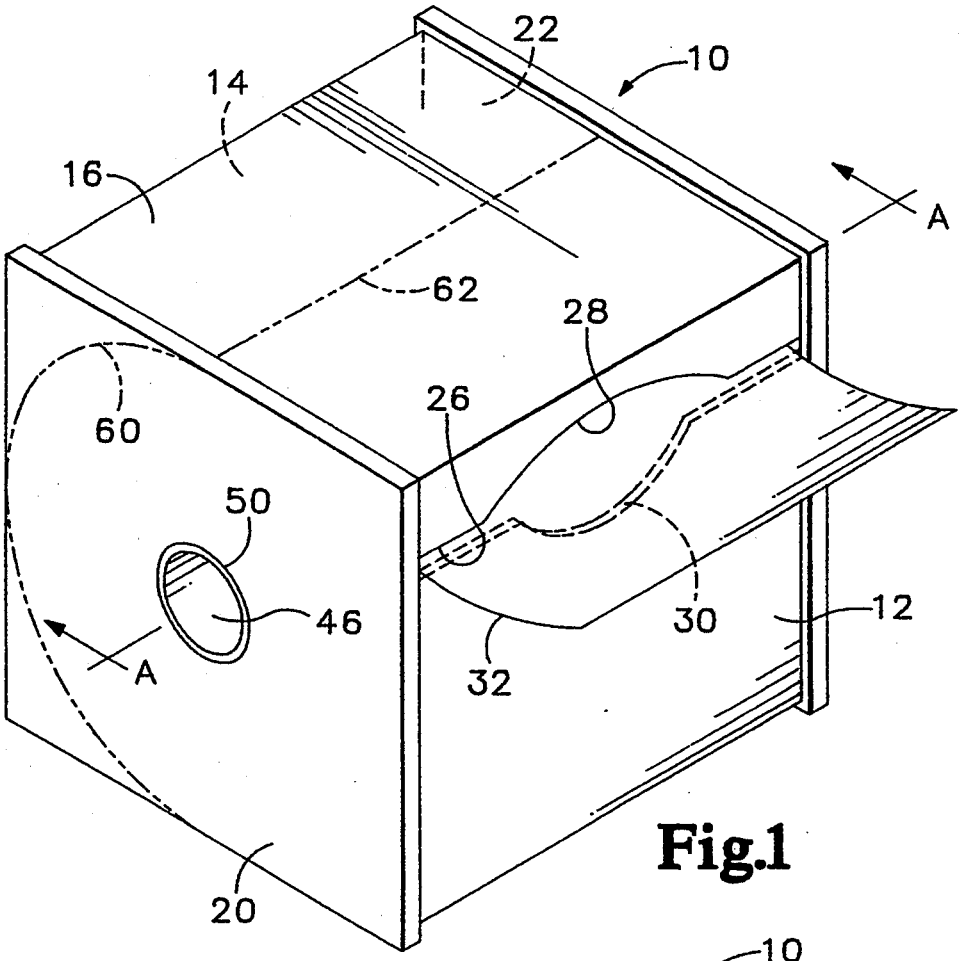
FIG. 1 is a perspective view of a dispenser according to the present invention.

Referring to the drawings and particularly to FIG. 1, the dispenser in accordance with the present invention comprises an approximately cubical container 10 having forward and rearward lateral walls 12 and 14, upper and lower lateral walls 16 and 18, and end walls 20 and 22 for completing an enclosure adapted to receive a roll of tissue paper 24, i.e., toilet tissue. The forward lateral wall 12 is provided with an exit orifice for the tissue, said orifice suitably comprising a horizontal slot 26 which is centrally widened to provide a finger hole having an arcuate upper edge 28 and a somewhat smaller lower arcuate edge 30 through which the tissue paper can be accessed in case it is torn off proximate slot 26. Normally, however, the leading edge of the tissue paper 32 is withdrawn for use as the dispenser container is supported on a horizontal surface with an orientation generally depicted in FIG. 1.

Figure 2:
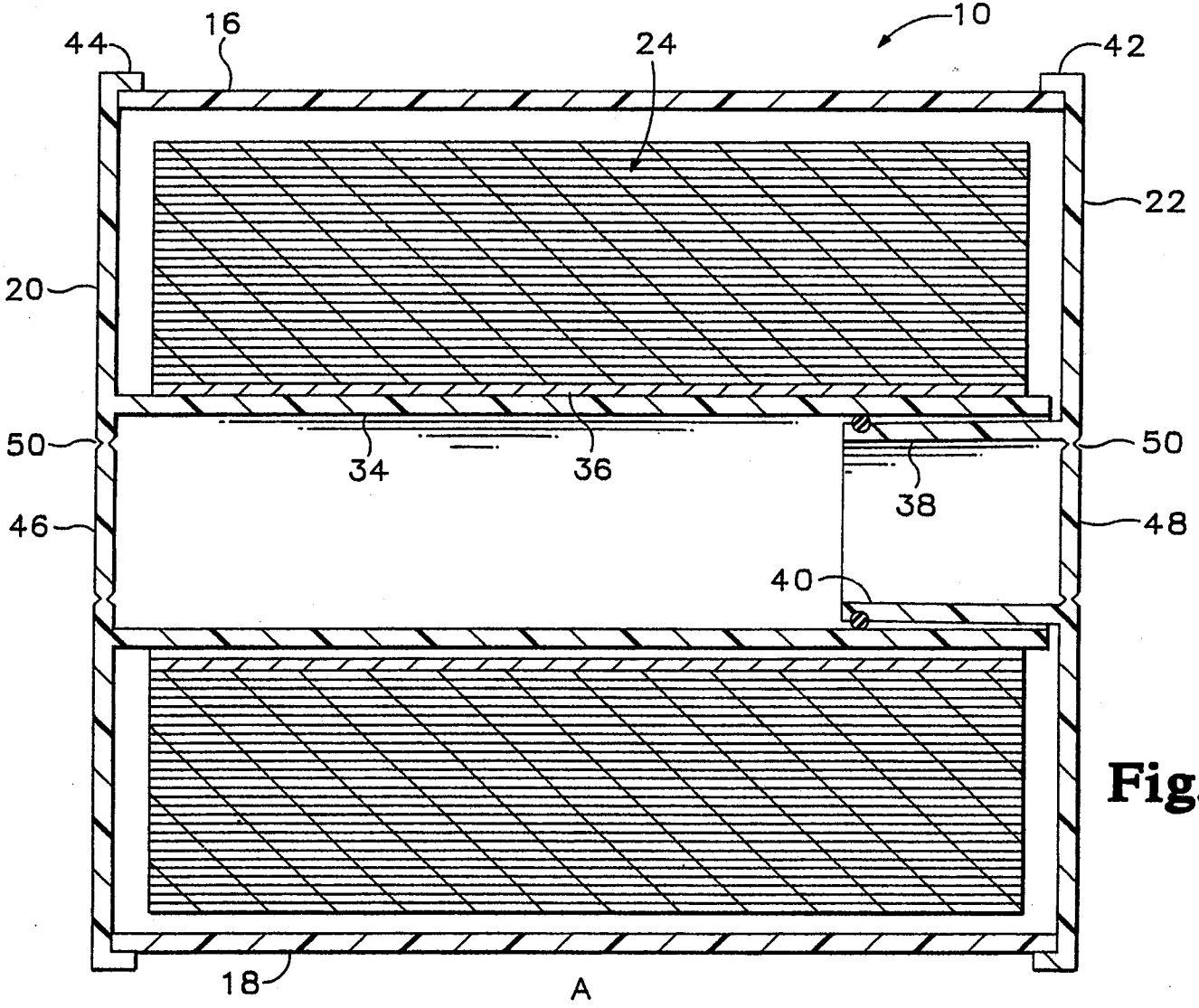
FIG. 2 is a longitudinal cross-sectional view of the FIG. 1 dispenser taken at A—A in FIG. 1.

Referring to FIG. 2, comprising a longitudinal cross-section of the FIG. 1 dispenser, end wall 20 is provided with a first mandrel portion 34 in the form of a long hollow cylindrical tube which is integral with and perpendicular to end wall 20 and which extends nearly the full length of the container 10 in the illustrated embodiment. The mandrel portion 34 is positioned by wall 20 centrally within the interior of container 10 in parallel relation to the lateral walls of the container, i.e., horizontally, and is normally received within cardboard tube 36 forming part of the tissue paper roll whereby the latter is centrally supported as it is unrolled. The opposite end wall 22 includes a second mandrel portion 38 integral with and perpendicular to wall 22. Mandrel portion 38 is smaller in outside diameter than the inside diameter of mandrel portion 34. Mandrel portion 38 comprises a short hollow cylindrical "stub" tube centrally positioned by end wall 22 so that it normally extends coaxially within long tube 34, stub tube 38 being provided with means for frictionally engaging the interior of tube 34. Such means advantageously comprises rubber O-ring 40 fitted in a groove around the exterior of tube 38 and adapted to engage the interior of tube 34.

End wall 22 is provided with a peripheral lip 42 having an inside dimension for receiving the lateral walls 12, 14, 16 and 18 of the container. The opposite end wall 20 suitably has a similar lip 44 secured to the lateral container walls; however, the aforementioned lip 42 of wall 22 is not permanently secured to the lateral walls but is slideable with respect thereto whereby end wall 22 can be removed for allowing access to the interior of container 10 whereby a fresh tissue paper roll 24 can be inserted over the mandrel portions and the cardboard tube from the previous roll discarded. The mating relationship between mandrel portions 34 and 38 together with the frictional engagement provided by O-ring 40 provides ready access to the container interior while removably securing end wall 22 in place when the container 10 is in the position shown in FIG. 2.

The entire container, comprising lateral walls and end walls integral with mandrel portions, is suitably molded from plastic. The dispenser according to the present invention can be economically manufactured in essentially two pieces comprising removable wall 10 with its mandrel portion and wall 20 integral with adjoining lateral walls and its mandrel portion. Lip 44 in this case may be eliminated.

End walls 20 and 22 are desirably provided with knockout tabs or disks 46 and 48 centrally located on each of the end walls, being slightly smaller in diameter than the respective mandrel portions 34 and 38 and in alignment therewith to provide access to the interiors of the mandrel portions. These knockout tabs are defined by aligned circular grooves 50 on the inside surfaces and outside surfaces of respective end walls 20 and 22. Intermittent perforations may be provided along these grooves so the knockout tabs are easily removable.

Figure 3:
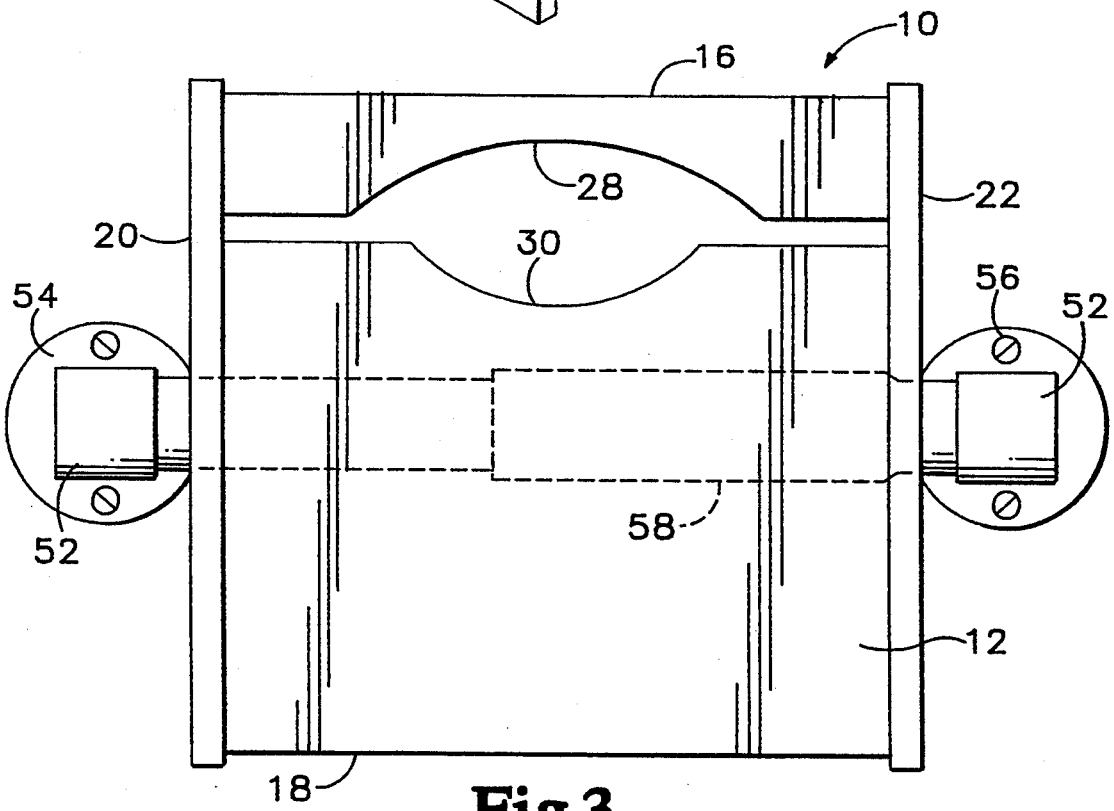
FIG. 3 is a forward view of the dispenser according to the present invention as mounted on a conventional bathroom fixture.

The reason for the knockout tab feature will be appreciated from reference to FIG. 3 wherein the container 10 is mounted in a conventional bathroom fixture, rearward wall 14 of container 10 resting against a bathroom wall between fixture posts 52. Each fixture post 52 is supported via a base 54 secured to the wall by screws 56 in a conventional manner. Posts 52 include right angle end sockets receiving an ordinary spring loaded bathroom fixture roller 58 passing through apertures left by removal of knockout tabs 46 and 48. In the case of a recessed, concave bathroom fixture, the rear wall of container 10 may be formed with a convex shape, intersecting and foreshortening the end walls of the container as well as the top and bottom lateral walls of the container as indicated in outline at 60 and 62 in FIG. 1. A small block of foam material (not shown) may be secured to the container rear wall to prevent rotation of the container within the fixture. The mandrel portions can also be made removable for bathroom use if so desired. Thus, the dispenser according to the present invention is adaptable to ordinary bathroom use in a manner for decoratively housing the tissue.

According to the present invention, an attractive dispenser for bathroom tissue facilitates use of the tissue for general household purposes, as well as for use in an automobile or elsewhere, as a substitute for effectively more expensive, interleaved facial tissue. Integral mandrel portions support and position the paper roll for smooth, easy, central withdrawal of paper, but with sufficient frictional force being provided between the roll and stationary mandrel so that excessive paper will not be discharged. The dispenser container is easily and economically formed in two parts to facilitate proper loading, while easy locking of a removable end part is provided via frictional engagement between the mandrel portions. Also, end knockout tabs enable simple conversion of the dispenser to more conventional bathroom use.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A dispenser for a roll of tissue paper, said dispenser comprising:

a container receiving said roll of tissue paper therewithin, said container having an exit orifice through which tissue paper may be withdrawn, said container having end sections, at least one of which is removable, one of said end sections including a mandrel portion extending within said container for carrying said roll of tissue paper wherein said mandrel portion is hollow for receiving a bathroom fixture roller adapted to support said container and wherein said one of said end sections is provided with a removable tab in alignment with the interior of said mandrel portion to provide access for inserting said bathroom fixture roller.

2. A dispenser for a roll of tissue paper having an interior tube, said dispenser comprising:

a container for receiving said roll of tissue paper, said container including end walls and a lateral wall therebetween provided with a dispensing opening through which paper is withdrawn from said roll as said roll unwinds, each of said end walls having a mandrel portion extending horizontally inwardly of said container in spaced relation with said lateral wall and in substantial alignment with the remaining mandrel portion at least one of the mandrel portions being smaller in outside diameter than the inside diameter of said interior tube so that said at least one of said mandrel portions is receivable substantially axially within said tube in supporting relation to said roll of tissue paper, wherein said mandrel portions normally extend in mating relation with one another within said container, one of said mandrel portions having at least a section of lesser diameter than the remaining mandrel portion for extending therewithin and wherein one of said mandrel portions is provided with friction means for engaging the remaining mandrel portion for effectively securing said mandrel portions together for thereby securing said one of said end walls to said container, wherein said friction means comprises an O-ring, and one of said end walls together with the mandrel portion supported thereby being removable from said container to provide access to the interior of said container for placement of said roll of tissue paper within said container.

3. A dispenser for a roll of tissue paper having an interior tube, said dispenser comprising:

a container for receiving said roll of tissue paper, said container including end walls and a lateral wall therebetween provided with a dispensing opening through which paper is withdrawn from said roll as said roll unwinds, each of said end walls having a mandrel portion extending horizontally inwardly of said container in spaced relation with said lateral wall and in substantial alignment with the remaining mandrel portion, at least one of the mandrel portions being smaller in outside diameter than the inside diameter of said interior tube so that said at least one of said mandrel portions is receivable substantially axially within said tube in supporting relation to said roll of tissue paper, one of said end walls together with the mandrel portion supported thereby being removable from said container to provide access to the interior of said container for placement of said roll of tissue paper within said container, wherein said mandrel portions are hollow for receiving a bathroom fixture roller for supporting said container, and wherein said end walls are provided with removable tabs in alignment with the interior of said mandrel portions to provide access for inserting said bathroom fixture roller.

4. A dispenser for a roll of tissue paper having an interior tube, said dispenser comprising:

a container for receiving said roll of tissue paper, said container including end walls and a lateral wall therebetween provided with a dispensing opening through which paper is withdrawn from said roll as said roll unwinds, each of said end walls having a mandrel portion extending horizontally inwardly of said container in spaced relation with said lateral wall and in substantial alignment with the remaining mandrel portion, at least one of the mandrel portions being smaller in outside diameter than the inside diameter of said interior tube so that said at least one of said mandrel portions is receivable substantially axially within said tube in supporting relation to said roll of tissue paper, one of said end walls together with the mandrel portion supported thereby being removable from said container to provide access to the interior of said container for placement of said roll of tissue paper within said container, wherein said container is provided with a rear wall opposite said lateral wall, said rear wall comprising a curved surface adapted to be receivable within a concave bathroom fixture, wherein said mandrel portions are hollow for receiving a roller comprising part of said bathroom fixture, and wherein said end walls are provided with removable tabs in alignment with the interior of said mandrel portions to provide access for inserting said bathroom fixture roller.

* * * * *